US008973182B2

(12) United States Patent
Crucs

(10) Patent No.: US 8,973,182 B2
(45) Date of Patent: Mar. 10, 2015

(54) DEVICES AND IMPLEMENTS FOR DETERRING MONSTERS, SPECTERS, DEMONS, AND THE LIKE

(75) Inventor: Kevin M. Crucs, Copley, OH (US)

(73) Assignee: Crucs Holdings, LLC, Copley, OH (US)

( * ) Notice: Subject to any disclaimer, the term of this patent is extended or adjusted under 35 U.S.C. 154(b) by 587 days.

(21) Appl. No.: 12/758,835

(22) Filed: Apr. 13, 2010

(65) Prior Publication Data

US 2011/0247136 A1 Oct. 13, 2011

(51) Int. Cl.

| | |
|---|---|
| ***A47G 9/00*** | (2006.01) |
| ***A47G 9/02*** | (2006.01) |
| ***A63H 33/22*** | (2006.01) |

(52) U.S. Cl.

CPC ..... *A47G 9/0207* (2013.01); *A47G 9/0215* (2013.01); *A47G 9/0246* (2013.01); *A47G 9/0253* (2013.01); *A47G 9/0261* (2013.01); *A47G 9/0284* (2013.01); *A47G 2009/005* (2013.01); *A47G 2009/006* (2013.01); *A63H 33/22* (2013.01)

USPC ..... 5/482; 5/506.1; 5/658; 5/423; 5/485; 340/573.1; 446/297

(58) Field of Classification Search

USPC ..... 5/482, 413, 485, 502, 506.1, 658, 5/652.1, 423

See application file for complete search history.

(56) References Cited

U.S. PATENT DOCUMENTS

| | | | | |
|---|---|---|---|---|
| 4,972,533 | A * | 11/1990 | Brown | 5/482 |
| 5,374,192 | A | 12/1994 | Marble et al. | |
| 6,023,802 | A | 2/2000 | King | |
| 6,377,177 | B1 * | 4/2002 | Broussard et al. | 5/482 |
| 6,513,164 | B1 | 2/2003 | Hearns | |
| 6,746,299 | B1 | 6/2004 | Graf | |
| RE38,782 | E | 8/2005 | Dix | |
| 7,049,968 | B2 | 5/2006 | Fitzgerald et al. | |
| 7,523,513 | B2 * | 4/2009 | Waters et al. | 5/482 |
| 2003/0159193 | A1 | 8/2003 | LeFevre et al. | |
| 2003/0182724 | A1 * | 10/2003 | Zheng | 5/413 R |
| 2004/0232170 | A1 | 11/2004 | Glick et al. | |

(Continued)

FOREIGN PATENT DOCUMENTS

| | | | |
|---|---|---|---|
| CN | 2891867 | Y | 4/2007 |
| CN | 2927871 | Y | 8/2007 |

(Continued)

*Primary Examiner* — Peter M Cuomo
*Assistant Examiner* — Brittany Wilson
(74) *Attorney, Agent, or Firm* — Hahn Loeser & Parks LLP; Brendan E. Clark

(57) ABSTRACT

A devices and implements for staving off monsters, specters, demons and the like as imagined by a child at bedtime. A hand-held controller unit is provided having a user interface and which is capable of being used by the child under the bed covers of a bed. The hand-held controller unit may include any of a walkie-talkie capability, a flashlight capability, a nightlight capability, the capability to activate an external device, and other capabilities. At least one external device may be provided. The external device may be capable of being placed beneath the bed and is configured to be activated by the hand-held controller unit. At least one substantially hollow air-through member may be provided which is configured to facilitate airflow between underneath the bed covers of the bed and above the bed covers of the bed. A supplemental bed cover may be provided that is configured to be placed on the bed.

21 Claims, 11 Drawing Sheets

(56) References Cited

U.S. PATENT DOCUMENTS

| | | | | |
|---|---|---|---|---|
| 2005/0102752 | A1* | 5/2005 | Abraham et al. | 5/482 |
| 2005/0197041 | A1 | 9/2005 | Fink | |
| 2006/0218726 | A1 | 10/2006 | Waters et al. | |
| 2007/0087657 | A1 | 4/2007 | Campbell et al. | |
| 2007/0287137 | A1 | 12/2007 | Crawford | |
| 2008/0113323 | A1 | 5/2008 | McElhoe | |
| 2008/0134432 | A1 | 6/2008 | Brandon | |
| 2009/0014956 | A1 | 1/2009 | Sutor, Jr. | |
| 2009/0089928 | A1* | 4/2009 | Kasbohm | 5/485 |
| 2009/0305600 | A1 | 12/2009 | Roesch | |
| 2010/0035509 | A1 | 2/2010 | Lei | |
| 2012/0005831 | A1* | 1/2012 | Waters et al. | 5/482 |

FOREIGN PATENT DOCUMENTS

| | | | |
|---|---|---|---|
| CN | 200938994 | Y | 8/2007 |
| WO | 9513045 | A1 | 5/1995 |
| WO | 0158320 | A1 | 8/2001 |
| WO | 03/030121 | A1 | 4/2003 |
| WO | 2004056237 | A2 | 7/2004 |
| WO | 2008002876 | A2 | 1/2008 |

* cited by examiner

DEVICES AND IMPLEMENTS FOR DETERRING MONSTERS, SPECTERS, DEMONS, AND THE LIKE

TECHNICAL FIELD

Certain embodiments of the present invention relate to calming the fears of children. More particularly, certain embodiments relate to devices and implements for staving off monsters, specters, demons and the like as imagined by a child at bedtime.

BACKGROUND

It is well known that young children often become afraid at bedtime because they imagine that there are monsters, specters, demons, or the like waiting to "get them", for example, when the lights are turned out. This can cause much anxiety for the child and prevent the child from calming down and going to sleep in a timely manner. Many parents use nightlights, or turn on a hallway light outside of the child's bedroom, to help mitigate the fear of the child. However, this may not be enough to alleviate the fear and anxiety of the child, especially if the child has a very active imagination. The child may need some significant extra help in staving off the monsters, specters, demons, or the like.

Further limitations and disadvantages of conventional, traditional, and proposed approaches will become apparent to one of skill in the art, through comparison of such approaches with the subject matter of the present application as set forth in the remainder of the present application with reference to the drawings.

SUMMARY

An embodiment of the present invention comprises a hand-held controller unit for staving off monsters, specters, demons and the like as imagined by a child at bedtime. The controller unit includes a housing and a user interface integrated with the housing and configured to respond to a user initiated action. The controller unit further includes a user interface control circuit integrated within the housing and operatively connected to the user interface. The controller unit also includes an audio transceiver circuit integrated within the housing and operatively connected to the user interface control circuit. The controller unit further includes at least one activating transmitter circuit integrated within the housing and operatively connected to the user interface control circuit and configured to activate at least one external device. The activating transmitter circuit may include a wireless transmitter. The external device may include at least one of an audio-producing device and a pulsating light-producing device. The controller unit also includes at least one energy-emitting device integrated with the housing and operatively connected to the user interface control circuit. The controller unit further includes an audio transducer integrated with the housing and operatively connected to the audio transceiver circuit. The energy-emitting device may include at least one of a flashing visible light-emitting device, an audible sound-emitting device, and a flashlight. The user interface may include at least one depressible member configured to communicate a signal to the user interface control circuit in response to a user-initiated action. The depressible member or some other portion of the user interface may provide visible illumination serving as a nightlight capability.

Another embodiment of the present invention comprises a kit for staving off monsters, specters, demons and the like as imagined by a child at bedtime. The kit includes a hand-held controller unit having a user interface and capable of being used by the child under the bed covers of a bed. The kit further includes at least one substantially hollow air-through member configured to facilitate airflow between underneath the bed covers and above the bed covers. The kit also includes at least one external device capable of being placed underneath the bed and configured to be activated by the hand-held controller unit in response to a child-initiated action. The external device annihilates, in the mind of the child, any monsters, specters, demons and the like that are imagined by the child to be under the bed, when activated via the hand-held controller unit. The hand-held controller unit may include means for facilitating audio communication between the child and a parent. The hand-held controller unit may further include means for wirelessly activating the external device. The external device may include at least one of means for producing an audible sound and means for producing a pulsating visible light. The hand-held controller unit may also include means for emitting energy. The means for emitting energy may be configured to emit at least one of a flashing visible light, an audible sound, and a steady visible light. The kit may further include means for fastening at least one insignia to at least one of a bed cover of the bed and a post of the bed. The at least on insignia helps to stave off the monsters, specters, demons and the like as imagined by the child. The kit may further include a scented perfume capable of being applied to the bedding of the bed and the child, wherein the scented perfume helps to stave off the monsters, specters, demons and the like as imagined by the child. The kit may further include a supplemental bed cover configured to be placed on the bed. The supplemental bed cover may include printed or sewn insignia to help stave off the monsters, specters, demons and the like as imagined by the child. The supplemental bed cover may include a pocket for storing the hand-held controller unit. The supplemental bed cover may include at least one air-through port configured to allow air to readily pass through the supplemental bed cover. The supplemental bed cover may include a first side attached to a second side and may be configured to fit over an existing bed cover. Furthermore, the supplemental bed cover may be made of a special material that helps to stave off the monsters, specters, demons and the like as imagined by the child.

A further embodiment of the present invention comprises a bed cover for staving off monsters, specters, demons and the like as imagined by a child at bedtime. The bed cover includes at least one external surface, at least one interior region, and at least one insignia on the at least one external surface for staving off monsters, specters, demons and the like as imagined by a child. The bed cover further includes a controller unit integrated within the at least one interior region. The controller unit includes at least one of an audio transceiver device, an activating transmitter device, and an energy-emitting device. The bed cover also includes a user interface operatively connected to the controller unit and integrated into the at least one external surface. The insignia may be printed on or sewn on the at least one external surface. The bed cover may further include at least one air-through port configured to allow air to readily pass through the bed cover. The bed cover may also include a first side attached to a second side and configured to fit over an existing bed cover. At least a portion of the bed cover may be made of a special material that helps stave off the monsters, specters, demons and the like as imagined by a child.

These and other novel features of the subject matter of the present application, as well as details of illustrated embodiments thereof, will be more fully understood from the following description and drawings.

DETAILED DESCRIPTION

Figure 1:
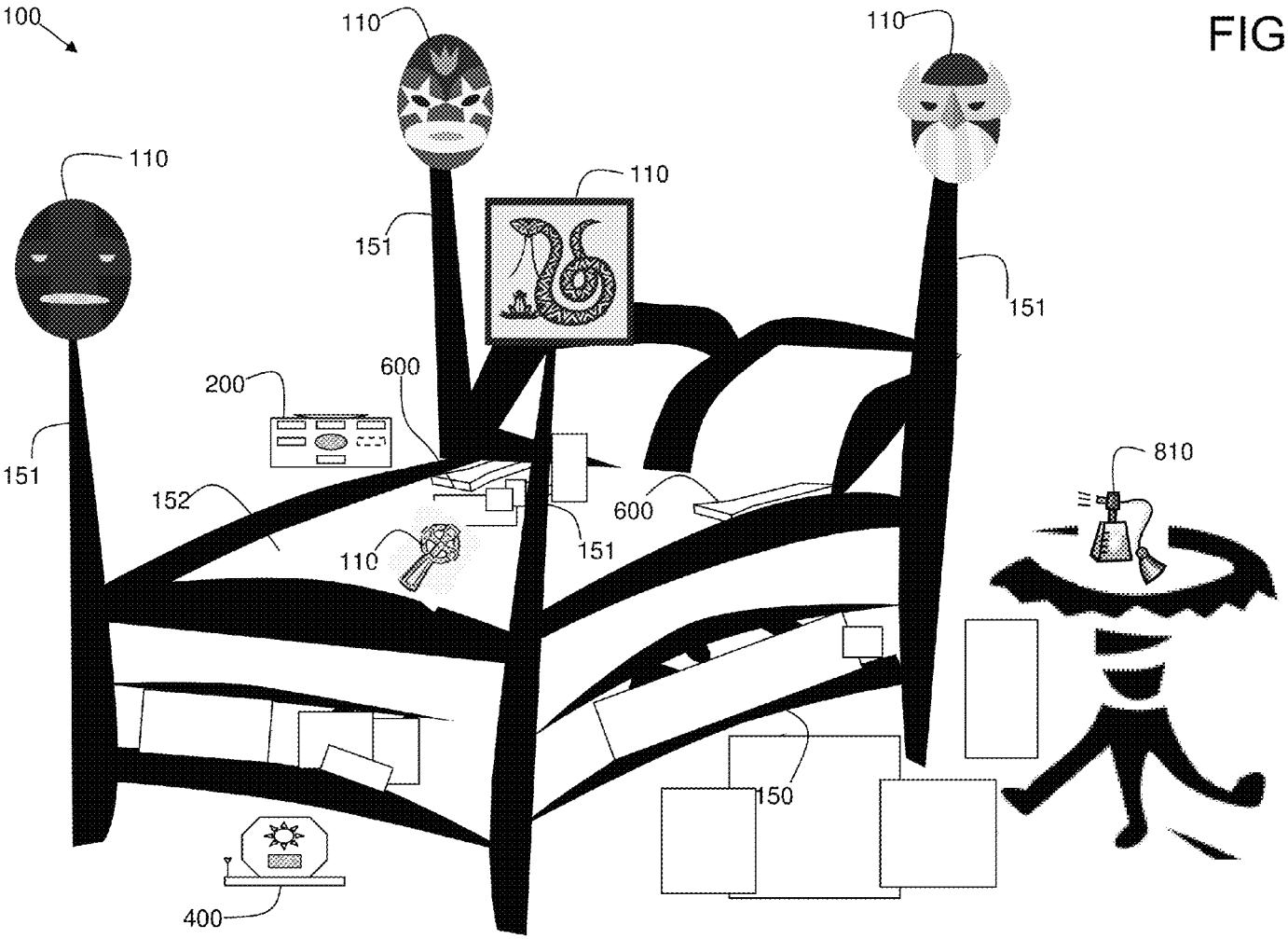
FIG. 1 illustrates an example embodiment of a kit set up for bedtime for staving off monsters, specters, demons and the like as imagined by a child.

FIG. 1 illustrates an example embodiment of a kit 100 set up for bedtime for staving off monsters, specters, demons and the like (a.k.a., unfriendlies) as imagined by a child. The kit 100 includes a hand-held controller unit 200, a plurality of insignia 110, an external device 400, a pair of hollow air-through members 600, and a scented perfume 810 (e.g., a spray mist bottle containing a liquid having a particular scent). Alternatively, a spray mist or water spray may be used in lieu of the scented perfume 810. For example, if a child is sensitive to a particular scent, the scented perfume 810 may be used as a container for a different anti-monster repellant. Each of the elements of the kit 100 are positioned with respect to a child's bed 150 and serve, in their own way, to stave off monsters, specters, demons and the like as imagined by a child. In general, the kit 100 serves to provide psychological comfort to the frightened child at bedtime when it is suggested to the child how the various elements of the kit 100 will keep the child protected from such monsters, specters, demons and the like.

For example, a child may be afraid to go to bed because the child imagines that there are or may be unfriendlies lurking around the bed 150 or underneath the bed 150 when the lights are turned out. The child may hide under the bed cover(s) 152 of the bed in an attempt to hide from such unfriendlies. The insignia 110 are placed on and/or fastened to the posts 151 and/or the bed covers 152 of the bed 150 and serve to frighten and keep away such monsters, specters, demons and the like in the mind of the child. Similarly, the scented perfume 810 is in a container and may be sprayed or splattered on and/or around the bed 150 and serves to keep away such unfriendlies in the mind of the child. As used herein, the terms bed cover or bed covers refer to any of blankets, sheets, comforters, pillow cases, or any other type of bedding.

The hollow air-through members 600 are positioned to allow air to flow between underneath the bed covers 152, where the child may be hiding, and above the bed covers 152 providing additional air circulation and comfort for the child. The hand-held controller unit 200 may be operated by the child, even under the bed covers 152, to allow the child to actively stave off such monsters, specters, demons and the like as imagined by the child. For example, the external device 400 may be activated by the child via the hand-held controller unit 200 as is described in more detail later herein.

Figure 2:
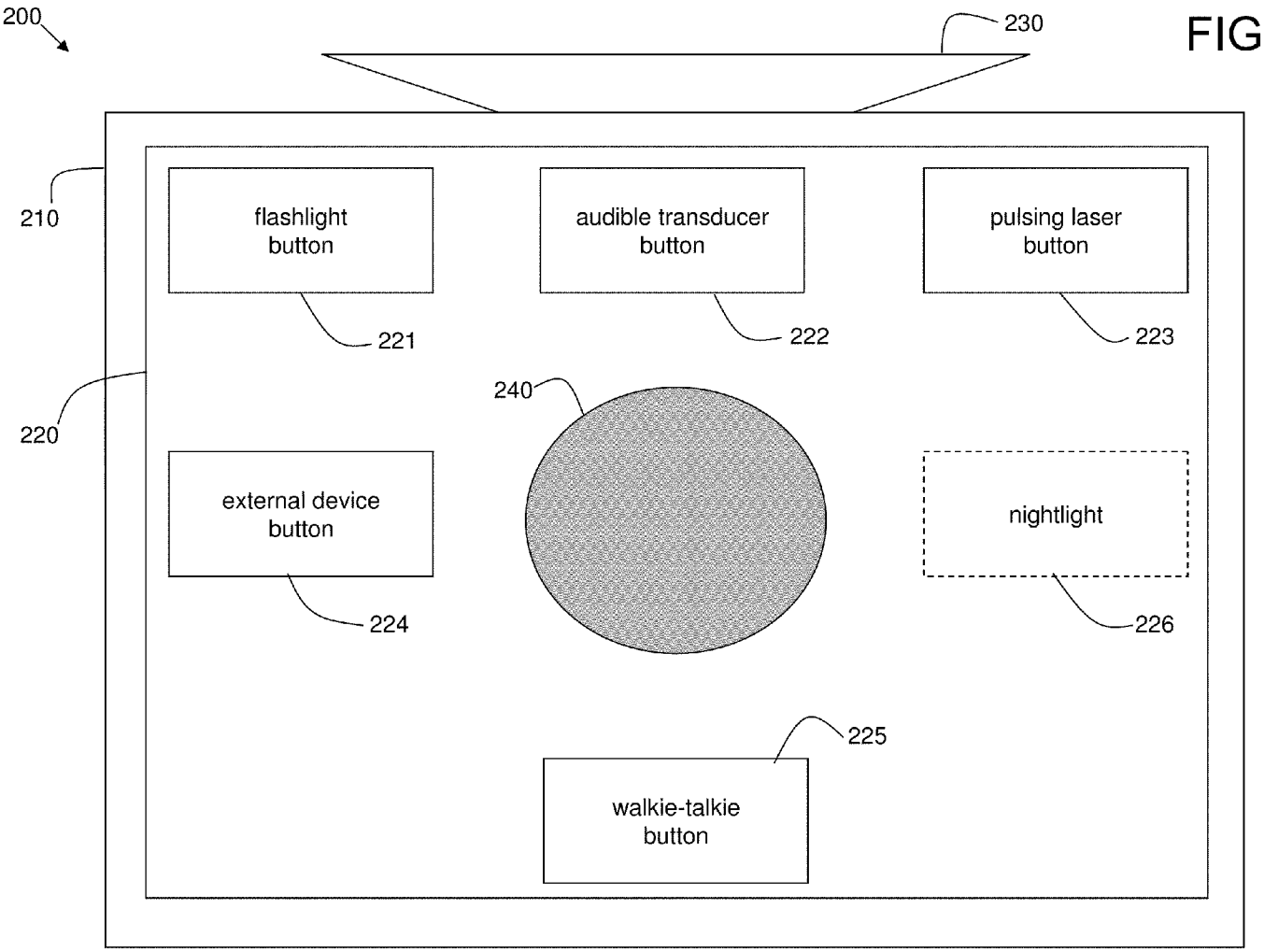
FIG. 2 illustrates an example embodiment of a hand-held controller unit of the kit of FIG. 1 showing a housing and user interface.

FIG. 2 illustrates an example embodiment of the hand-held controller unit 200 of the kit 100 of FIG. 1 showing a housing 210, a user interface 220, and an energy-emitting port 230. The housing is substantially rectangular in shape, in accordance with an embodiment of the present invention. However, other housing shapes are possible as well. The user interface 220 is integrated into a top portion of the housing 210 and includes a plurality of depressible members or buttons 221-225 which may be activated by a child in his/her battle against the imagined unfriendlies. As an alternative, the depressible buttons may instead be touch-sensitive positions on the user interface 220, for example, in accordance with another embodiment of the present invention. Other embodiments are possible as well using, for example, switches or other user-activating means, in accordance with other alternative embodiments of the present invention.

As an alternative, the housing 210 may comprise a padded or compressible material, such that a child may safely sleep with it. For example, in one embodiment, the housing 210 may be a stuffed animal, such that the user interface 220 is integrated into an outer surface of the stuffed animal. Additionally, the controller unit 200 may be integrated into a padded ball, a sheet, a blanket, a throw, or the like, for example, in accordance with other embodiments of the present invention.

As an example, the button 221 may be depressed by the child to activate a flashlight capability that provides a broad and steady illuminating light out of the energy-emitting port 230. In use, the flashlight capability may allow a child to take the controller unit to various areas in or out of the bedroom while having the ability to keep the area illuminated. Similarly, the button 222 may be depressed by the child to activate an audible sound capability that provides an audible sound out of the energy-emitting port 230 which the child believes helps to keep the monsters, specters, demons and the like at bay. The button 223 may be depressed by the child to activate a simulated laser capability that provides a narrow and pulsing illuminating light out of the energy-emitting port 230. The button 224 may be depressed by the child to activate the external device 400 as is described in more detail later herein.

The button 225 may be depressed by the child providing the capability for the child to communicate with, for example, a parent of the child via a walkie-talkie capability. For example, when the child depresses the button 225, the child may speak into the audio transducer 240 (serving as a microphone) to communicate with the parent who has a walkie-talkie transceiver device 710 (see FIG. 7). When the child lifts up on the button 225, the child may listen to a response of the parent via the audio transducer (now serving as a speaker). In this manner, the child may be comforted by the fact that he/she may communicate immediately with the parent at any time without having to scream or yell to get the attention of the parent.

As an option, the user interface 220 may include a nightlight 226 that provides a nightlight capability for the child, which may be especially desirable when the child is hiding under the bed covers. The nightlight 226 may be on all the time or may be turned on and off, for example, by pressing down on the nightlight 226 (e.g., the nightlight 226 may be configured as a depressible button). Alternatively, any or all of the buttons 221-225 may be illuminated, or may be made from glow-in-the-dark material, providing such a nightlight capability, and further allowing the child to more readily see the various buttons 221-225.

Figure 3:
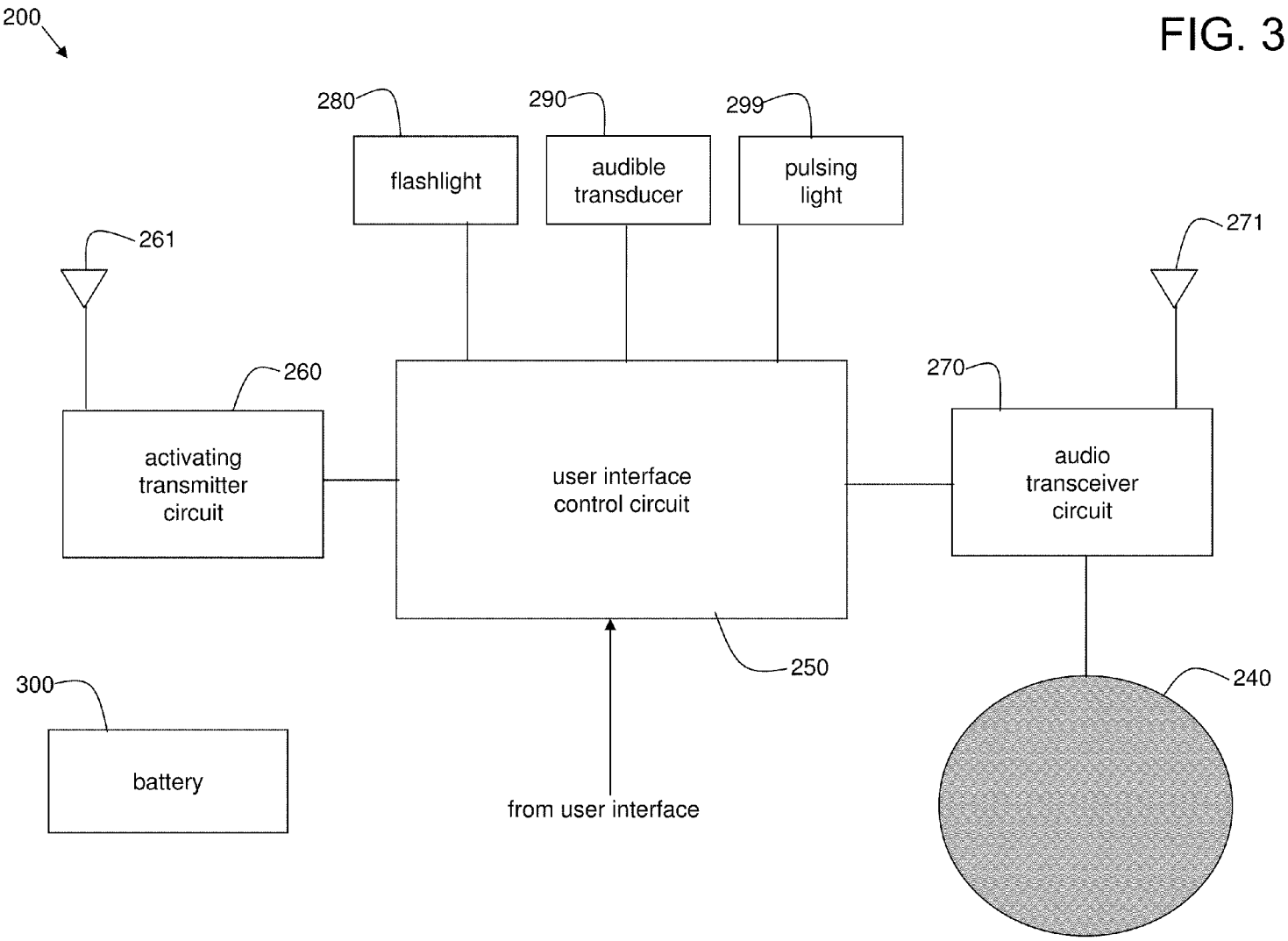
FIG. 3 illustrates an example embodiment of the integrated circuitry of the hand-held controller unit of FIG. 2.

FIG. 3 illustrates an example embodiment of the electronic circuitry integrated within the hand-held controller unit 200 of FIG. 2. The circuitry of the hand-held controller unit 200 includes a user interface control circuit (UICC) 250 which operatively interfaces to the user interface 220. For example, the various buttons 221-225 interface to the UICC 250 such that, when one of the buttons 221-225 is depressed, an associated command signal is sent to the UICC 250. The UICC 250 includes various electronic components that are well known in the art for accomplishing the various functions described herein. Such electronic components may include, for example, resistors, capacitors, transistors, logic circuits, and a logic processor such as a programmable microprocessor.

The circuitry of the hand-held controller 200 further includes an activating transmitter circuit 260 operatively interfacing to the UICC 250. When a user (e.g., a child) presses the external device button 224 on the user interface 220, a command signal is sent to the UICC 250 and the UICC 250, in response, sends a command signal to the activating transmitter circuit 260. In response, the activating transmitter circuit 260 transmits a wireless signal (e.g., a radio frequency signal) to the external device 400 causing the external device to be activated as is described later herein in more detail. The activating transmitter circuit 260 may include a radio frequency antenna 261 facilitating RF transmission to the external device 400. In accordance with certain other alternative embodiments, the activating transmitter circuit 260 may transmit an infrared signal or some other type of signal (e.g., Wi-fi®, Bluetooth®) when activated. Alternatively, the activating transmitter circuit 260 may be hard-wired to the external device 400 (e.g., via a local area network or by any other communication means known to a person of ordinary skill in the art and chosen with sound engineering judgment). Additionally, the hand-held controller unit 200 may be hard-wired to other elements in the kit such as, for example, external lights attached to the bedposts of the bed 150.

The circuitry of the hand-held controller 200 also includes an audio transceiver circuit 270 operatively interfacing between the UICC 250 and the audio transducer 240. The audio transceiver circuit 270 provides a radio frequency walkie-talkie capability. When a user presses the walkie-talkie button 225 on the user interface 220, a command signal is sent to the UICC 250 and the UICC 250, in response, sends a command signal to the audio transceiver circuit 270, commanding the audio transceiver circuit to switch from a receiving mode to a transmitting mode. When "on", the audio transceiver circuit 270 is normally in a receiving mode. The user interface 220 may further include a walkie-talkie on/off button (not shown) which allows the audio transceiver circuit 270 to be turned on and off. The audio transceiver circuit 270 includes a radio frequency antenna 271 facilitating RF communication.

The circuitry of the hand-held controller 200 also includes a flashlight 280 (e.g., an energy-emitting device such as an incandescent light bulb or an LED array). When a user presses the flashlight button 221, a command signal is sent to the UICC 250 and the UICC 250, in response, provides electrical current to the flashlight 280 causing the flashlight 280 to emit a visible illuminating light. In accordance with an embodiment of the present invention, the energy-emitting port 230 is configured to facilitate transmission of the light out of the housing 210. For example, the energy-emitting port 230 may include an optical lens (not shown) to direct the light broadly. The flashlight capability may be used by the child to aid his/her vision under the bed covers 152 and/or to allow the child to view around the child's bedroom when the bedroom lights are turned out.

The circuitry of the hand-held controller 200 further includes an audible sound emitting device or audible transducer 290 (e.g., an energy-emitting device such as a beeper, a buzzer, or a zapper) capable of producing an audible sound when activated. When a user presses the audible transducer button 222, a command signal is sent to the UICC 250 and the UICC 250, in response, provides electrical current to the audible transducer 290. In accordance with an embodiment of the present invention, the energy-emitting port 230 is configured to facilitate transmission of the audible sound out of the housing 210. For example, the energy-emitting port 230 may include an amplifying cone or a speaker (not shown). The child may decide to activate the audible transducer 290 to help scare away monsters, specters, demons and the like as imagined by the child.

The circuitry of the hand-held controller 200 also includes a pulsing or flashing light 299 (i.e., an energy-emitting device) that simulates a pulsing laser beam, in accordance with an embodiment of the present invention. When a user presses the pulsing laser button 223, a command signal is sent to the UICC 250 and the UICC 250, in response, provides a pulsed electrical current to the pulsing light 299. In accordance with an embodiment of the present invention, the energy-emitting port 230 is configured to facilitate transmission of the pulsing light out of the housing 210. For example, the energy-emitting port 230 may include an optical lens (not shown) to focus the pulsing light into a narrow laser-like beam. The child may decide to activate the pulsing light 299 to fight off any monsters, specters, demons and the like as imagined by the child.

In accordance with an embodiment of the present invention, the hand-held controller unit 200 includes a replaceable battery 300 for electrically powering the various circuitry of the hand-held controller unit 200. The battery 300 and the various circuitry 250-299 of the hand-held controller unit 200 are mounted within the housing 210 of the hand-held controller unit 200 via, for example, a printed circuit board (not shown). In accordance with other embodiments of the present invention, other power sources other than the battery 300 may be used to power the circuitry of the hand-held controller unit 200. For example, the hand-held controller unit 200 may be configured to plug into an electrical wall outlet via an AC-to-DC power converter (not shown).

Figure 4:
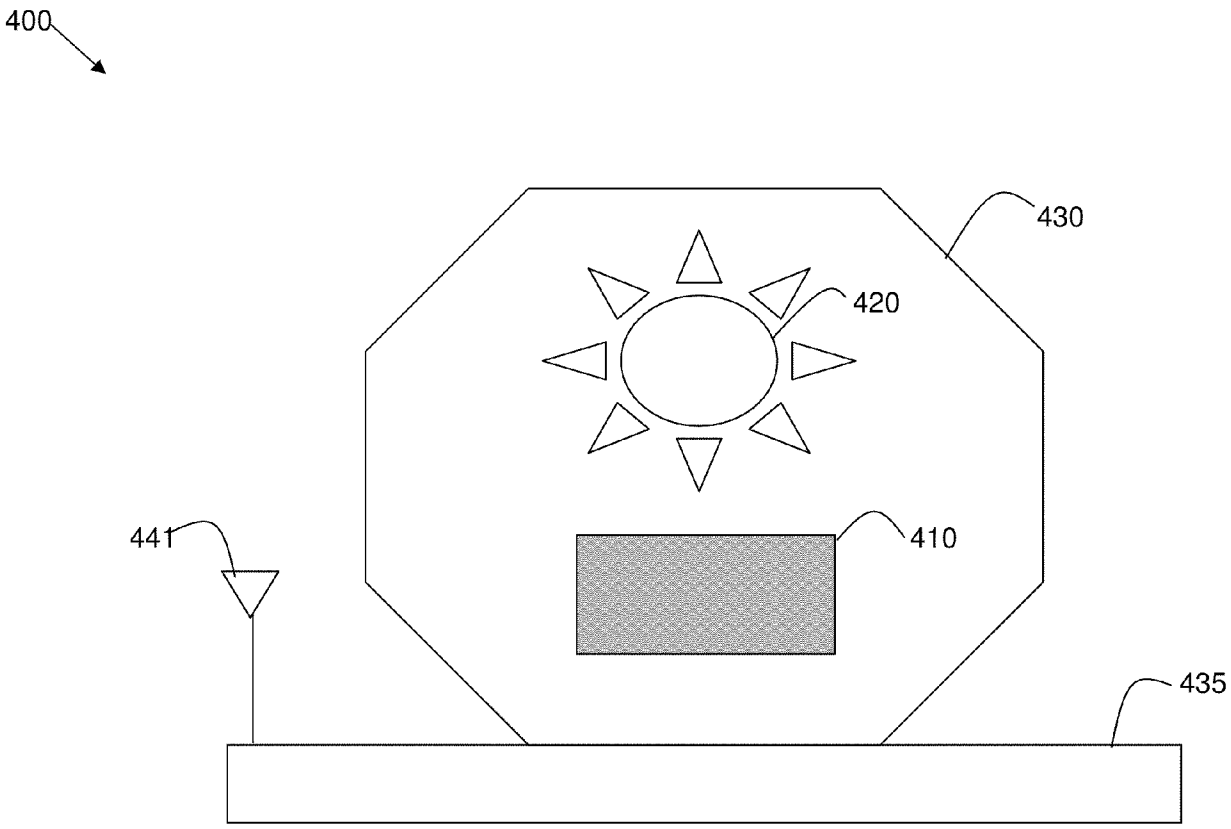
FIG. 4 illustrates an example embodiment of an external device of the kit of FIG. 1 which is capable of being activated by the hand-held controller unit of FIG. 2.

FIG. 4 illustrates an example embodiment of an external device 400 of the kit 100 of FIG. 1 which is capable of being activated by the hand-held controller unit 200 of FIG. 2. In accordance with an embodiment of the present invention, the external device 400 is configured to be placed under the bed 150 and produce a flashing or pulsating light and/or an alternating audible sound (e.g., a "zapping" sound) when activated by the hand-held controller unit 200. Such a flashing light and/or alternating audible sound annihilates any monsters, specters, demons and the like that are hiding under the bed as imagined by the child. When the child presses the external device button 224 on the hand-held controller unit 200, the flashing visible light and/or alternating audible sound is produced by the external device 400. The child may periodically press this button 224 while trying to go to sleep just to make sure that no such unfriendlies may survive under his/her bed 150. As an alternative, the external device 400 may be configured to be placed on or attached to a bed post, placed in a closet, or placed in any other area where a child may imagine unfriendlies to be hiding.

In accordance with an embodiment of the present invention, the external device 400 may include a timing mechanism. For example, the external device 400 may be preprogrammed to turn off at a specific time corresponding to the child's occupancy of the bedroom. Additionally, the external device may operate for a specified period of time determined by preprogrammed information, or the operation may be terminated by the child using the hand-held control unit 200, or via a switch on the external device 400. The external device may further include a light sensitive sensor, wherein the external device 400 may automatically activate or deactivate depending on the lighting conditions in the bedroom. Other external devices are possible as well including, for example, lights that may be placed in a closet and activated/deactivated via the controller unit 200 and/or via a timer.

In accordance with an embodiment of the present invention, the external device 400 includes at least one speaker 410 and at least one flashing or pulsating light 420 integrated into a at least partially transparent housing 430. The external device 400 may further include a base 435 for stability purposes when the external device 400 is placed on the floor under the bed 150. The base 435 may include at least one through-hole (not shown) for mounting the external device 400 to the underside of the bed 150, for example. Adhesives or hook and loop fasteners may also be used to secure the external device 400 to the underside of the bed 150, or used to keep the external device 400 in a specific location chosen by the user.

Figure 5:
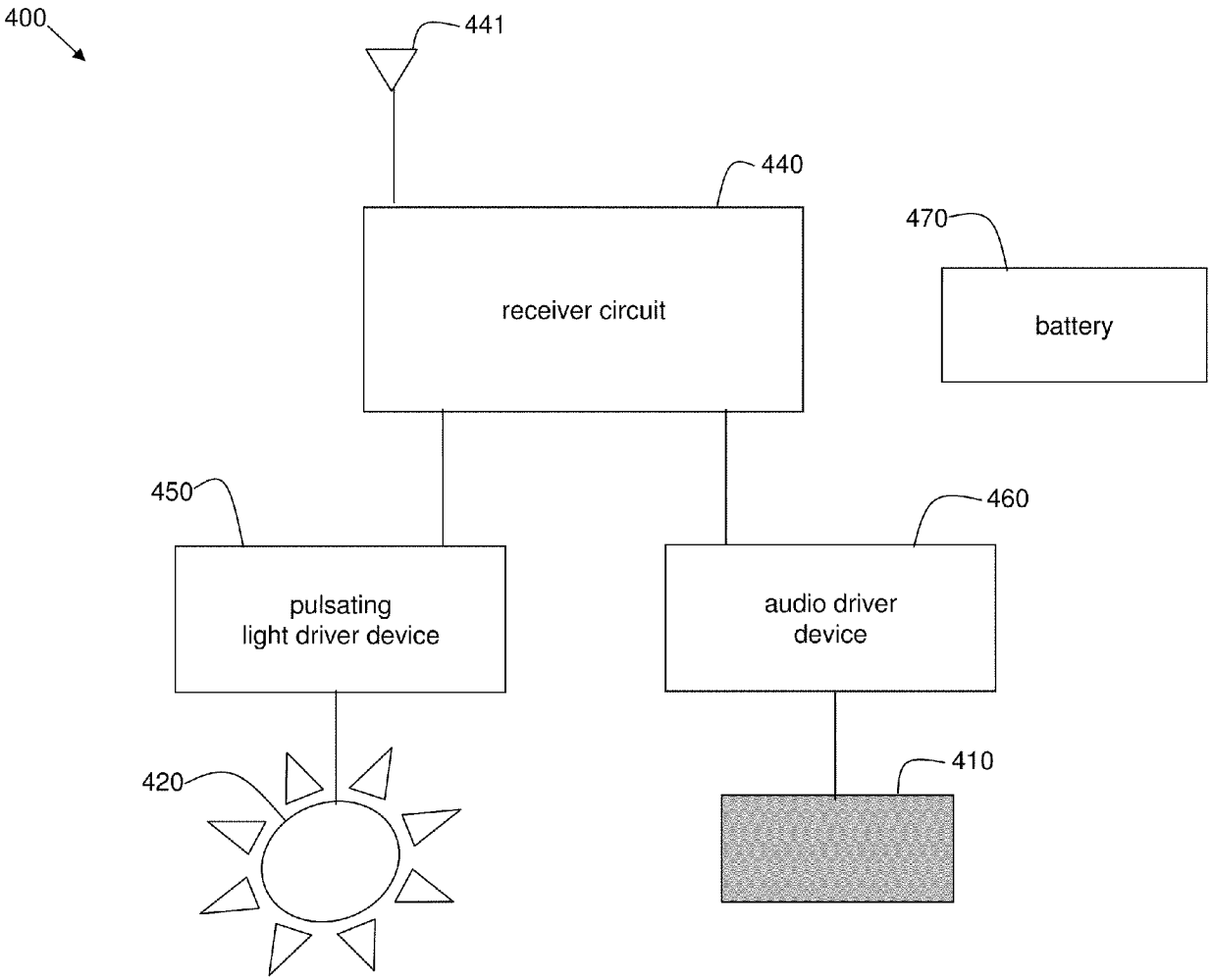
FIG. 5 illustrates an example embodiment of the integrated circuitry of the external device of FIG. 4.

FIG. 5 illustrates an example embodiment of the circuitry integrated into the external device 400 of FIG. 4. The circuitry includes a receiver circuit 440 for receiving a transmitted signal from the activating transmitter circuit 260 of the hand-held controller unit 200. The receiver circuit 440 may be configured to receive a radio frequency signal, an infrared signal, an ultrasonic signal, or some other type of signal in accordance with various embodiments of the present invention. A radio frequency antenna 441 is operatively connected to the receiver circuit 440 to facilitate radio frequency reception, in accordance with an embodiment of the present invention.

The circuitry further includes a flashing or pulsating light driver device 450 operatively connected between the receiver circuit 440 and the flashing light 420. When the receiver circuit 440 receives the transmitted signal from the hand-held controller unit 200, the receiver circuit 440 sends an activating command to the flashing light driver device 450. The flashing light driver device 450 provides electrical current to the flashing light 420 causing the flashing light 420 to emit a visible flashing or pulsating light. The flashing light driver device 450 and the flashing light 420 together constitute a pulsating or flashing light producing device.

The circuitry also includes an audio-driver device 460 operatively connected between the receiver circuit 440 and the speaker 410. When the receiver circuit 440 receives the transmitted signal from the hand-held controller unit 200, the receiver circuit 440 sends an activating command to the audio-driver device 460. The audio-driver device 460 provides an audio signal that alternates in amplitude and frequency to the speaker 410 causing the speaker 410 to emit an alternating audio sound. The audio driver device 460 and the speaker 410 constitute an audio producing device.

As a result, when a child presses the external device button 224 on the hand-held controller unit 200, the external device 400 is activated to produce both the flashing visible light and the alternating audio sound to annihilate any monsters, specters, demons and the like that are hiding under the bed as imagined by the child.

In accordance with an embodiment of the present invention, the external device 400 includes a replaceable battery 470 for electrically powering the various circuitry of the external device 400. The battery 470 and the various circuitry of the external device 400 are mounted within the housing 430 of the external device 400 via, for example, a printed circuit board (not shown). In accordance with other embodiments of the present invention, other power sources other than the battery 470 may be used to power the circuitry of the external device 400. For example, the external device 400 may be configured to plug into an electrical wall outlet via an AC-to-DC power converter (not shown).

Figure 6:
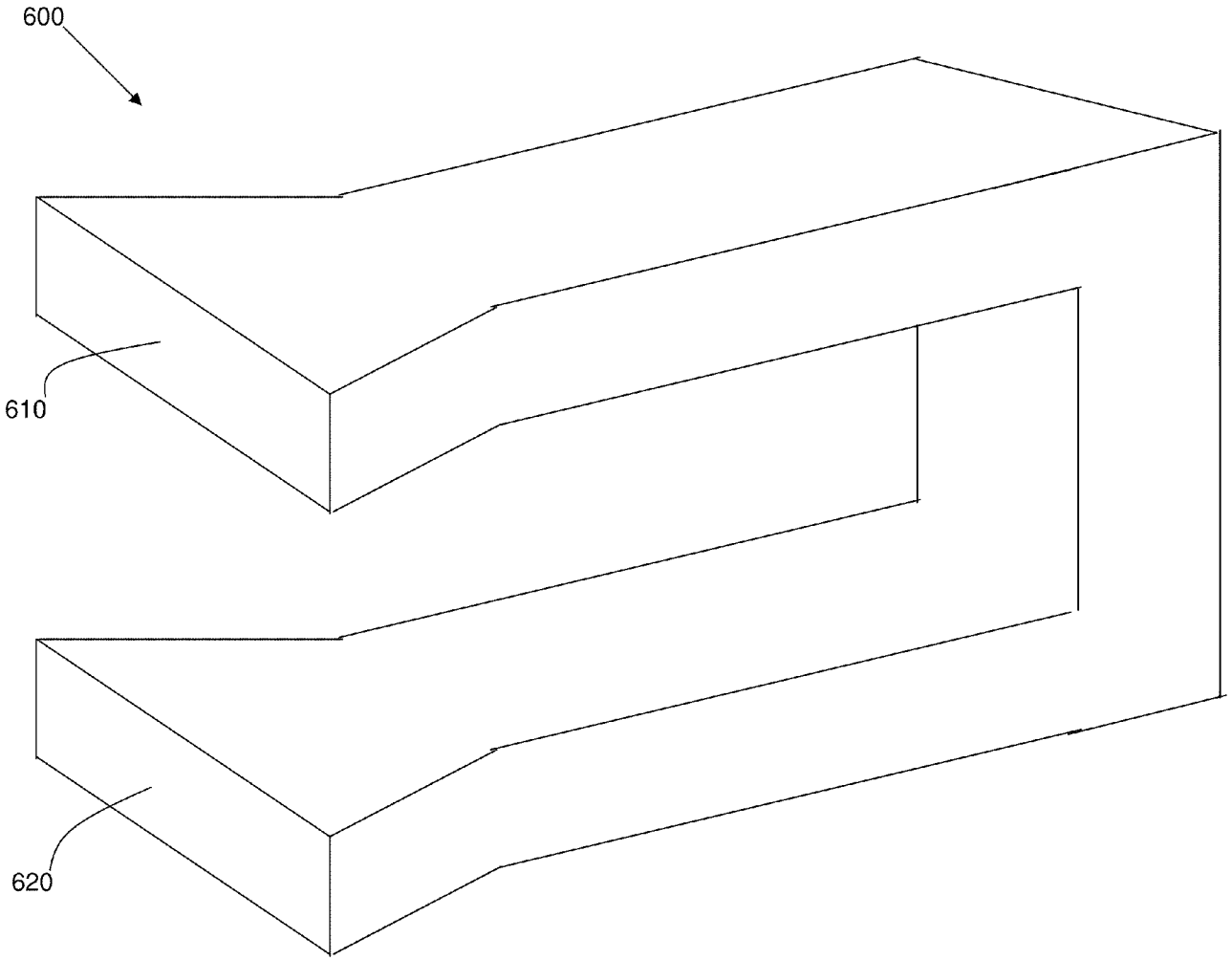
FIG. 6 illustrates an example embodiment of a hollow air-through member of the kit of FIG. 1 configured to facilitate airflow between underneath the covers of a bed and above the covers of the bed.

FIG. 6 illustrates an example embodiment of a hollow air-through member 600 of the kit 100 of FIG. 1 configured to facilitate airflow between underneath the bed covers 152 of a bed 150 and above the bed covers 152 of the bed 150. The air-through member 600 includes a first open port 610 and a second open port 620. The air-through member 600 is configured in a substantially inward flexing, C-shaped configuration such that the air-through member 600 may effectively clamp onto an edge of the bed covers 152 of the bed 150, where the first open port 610 is above the bed covers 152 and the second open port 620 is beneath the bed covers 152. In this manner, the flow of air is facilitated from above the bed covers 152 to beneath the bed covers 152 such that a child hiding under the bed covers 152 is supplied with sufficient air. As shown in FIG. 1, two hollow air-through members 600 are provided in the kit 100 and are clamped on either side of the bed covers 152 near the top of the bed covers 152 where a child's head is likely to be. In accordance with alternative embodiments of the present invention, the hollow air-through members 600 may be configured differently such as, for example, as long substantially hollow members extending from beneath the bed covers 152 to a floor of the bedroom. Other configurations are possible as well.

Figure 7:
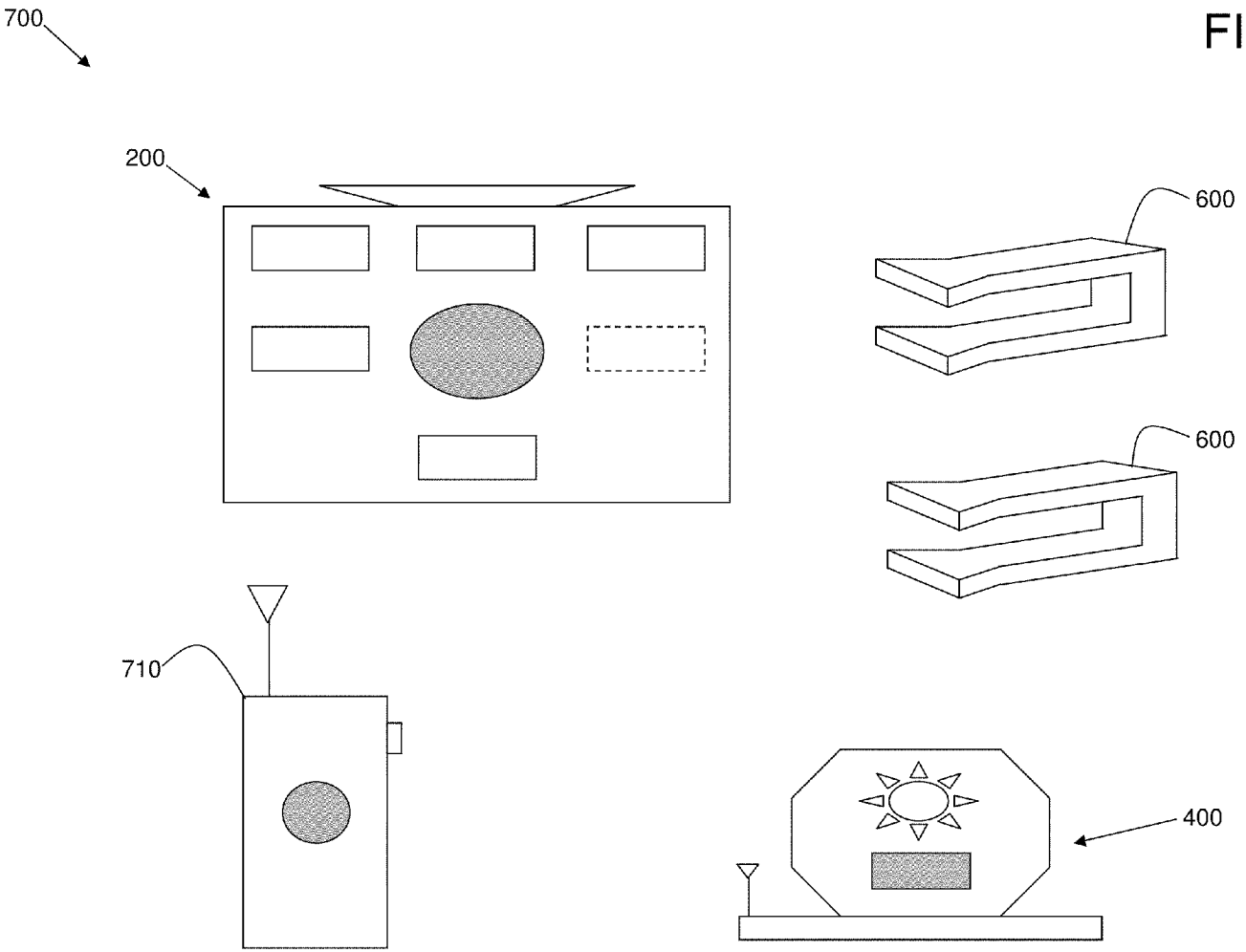
FIG. 7 illustrates an example embodiment of a kit for staving off monsters, specters, demons and the like as imagined by a child, where the kit includes a hand-held controller unit, an external device, two hollow air-through members, and a walkie-talkie transceiver device.

FIG. 7 illustrates an example embodiment of a kit 700 for staving off monsters, specters, demons and the like as imagined by a child, where the kit 700 includes a hand-held controller unit 200, an external device 400, two hollow air-through members 600, and a walkie-talkie transceiver device 710. Such a kit 700 may be provided for sale in order to convert or retrofit an existing child's bed and bed coverings with the elements of the kit 700 in order to stave off monsters, specters, demons and the like as imagined by the child.

Figure 8:
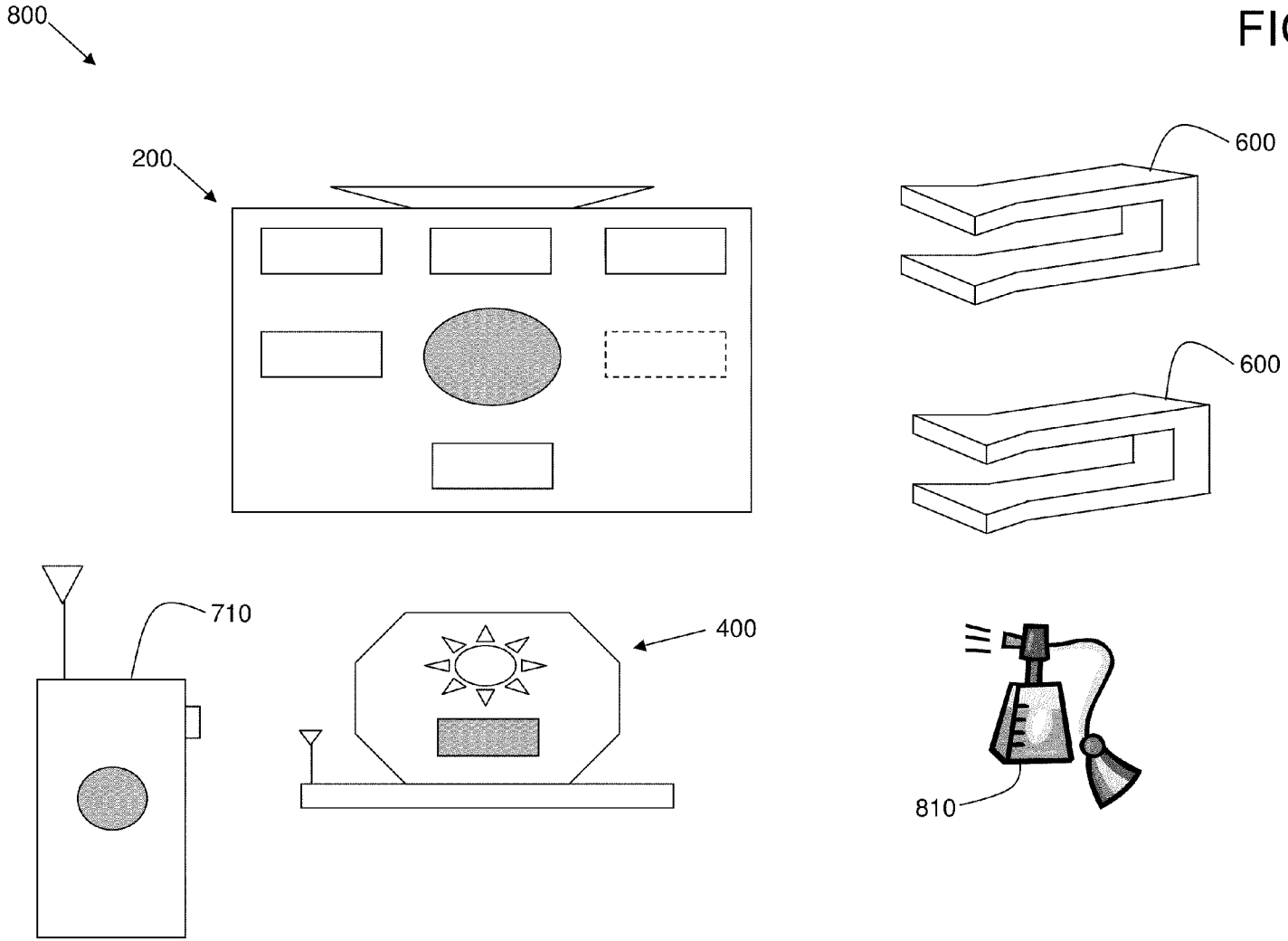
FIG. 8 illustrates an example embodiment of the kit of FIG. 7 further including a scented perfume sprayer to help in staving off monsters, specters, demons and the like as imagined by a child.

FIG. 8 illustrates another example embodiment of a kit 800 for staving off monsters, specters, demons and the like as imagined by a child, where the kit 800 includes a hand-held controller unit 200, an external device 400, two hollow air-through members 600, a walkie-talkie transceiver device 710, and scented perfume 810. Such a kit 800 may be provided for sale in order to convert or retrofit an existing child's bed and bed coverings with the elements of the kit 800 in order to stave off monsters, specters, demons and the like as imagined by the child.

Figure 9:
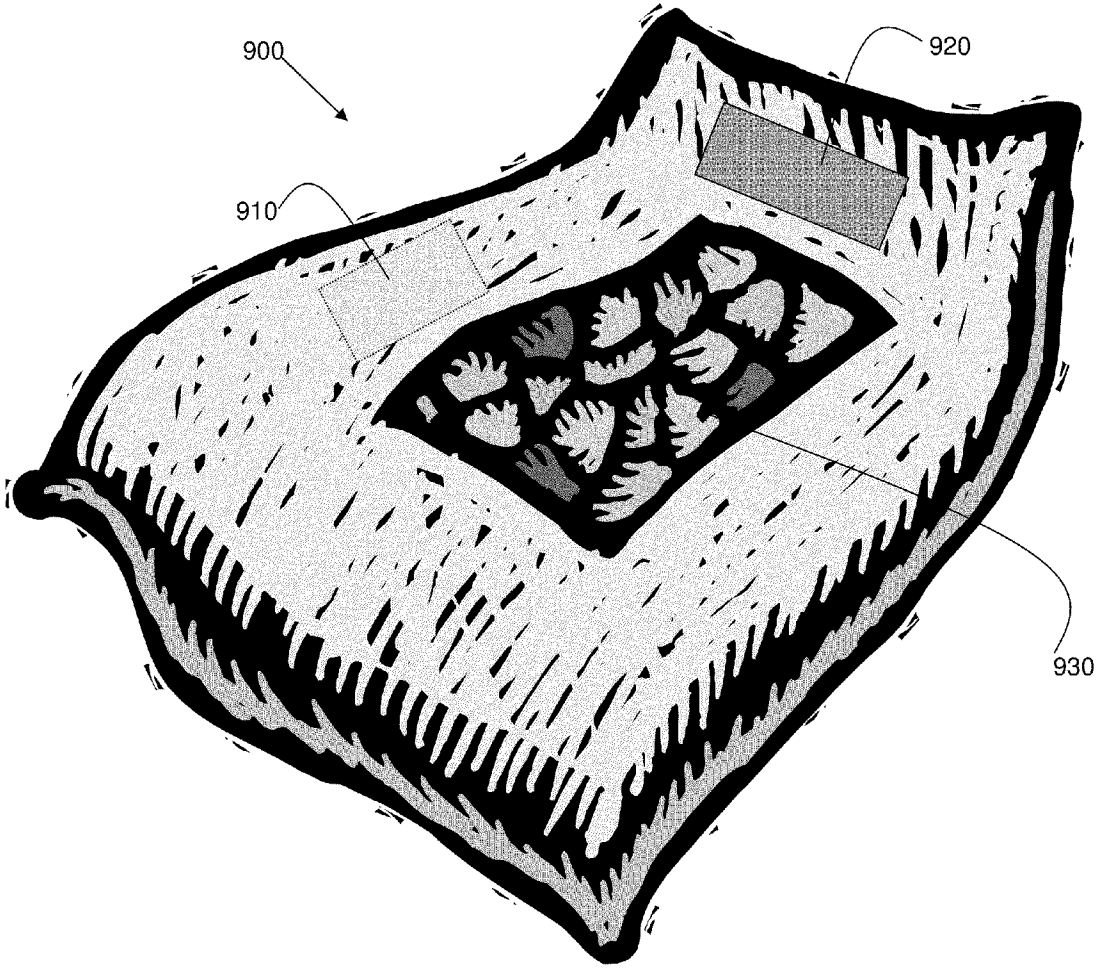
FIG. 9 illustrates an example embodiment of a blanket or cover having a pocket for storing the hand-held controller unit of FIG. 2, an air-through port for providing air to a child hiding under the blanket or cover at bedtime, and printed or sewn insignia to help in staving off the monsters, specters, demons and the like as imagined by the child.

FIG. 9 illustrates an example embodiment of a blanket or bed cover 900 having a pocket 910 for storing the hand-held controller unit 200 of FIG. 2, a air-through port 920 for providing air to a child hiding under the blanket or bed cover 900 at bedtime, and printed or sewn insignia 930 to help in staving off the monsters, specters, demons and the like as imagined by the child. Such a blanket or cover 900 may be used to replace or supplement the bed covers 152 on the child's bed 150. As an alternative, a pillow case, a flat or fitted sheet, a throw, or the like may be substituted for the blanket or cover 900, in accordance with other embodiments of the present invention. The hand-held controller unit 200 may be placed in the pocket 910, for example, during the day when the child is not using the bed 150. The pocket 910 may be on the top of the blanket 900 for easy access by, for example, a parent, or underneath the blanket 900 for easy access by a child hiding under the blanket 900. The air-through port 920 may take the place of or supplement the hollow air-through members 600. The air-through port 920 is sewn into a top portion (near where a child's head would be) of the blanket or cover 900 and is made of an air-permeable material (e.g., a mesh material) that allows air to flow from above the blanket 900 to beneath the blanket 900, in accordance with an embodiment of the present invention. Furthermore, a strip of lighting may be provided as a part of an edge of the blanket or cover 900.

In accordance with an embodiment of the present invention, the blanket or cover 900 includes a first side attached to a second side and is configured to fit over an existing bed cover or covers 152 (e.g., slide over the existing bed covers 152 such that the existing bed covers end up between the first side and the second side of the blanket 900). In accordance with an embodiment of the present invention, the child may be told that the blanket 900 is made of a special material that helps to stave off the monsters, specters, demons, and the like as imagined by the child. Such a special material may be a material that the child is not familiar with such as, for example, silk or cashmere, to make the material seem special to the child.

Figure 10:
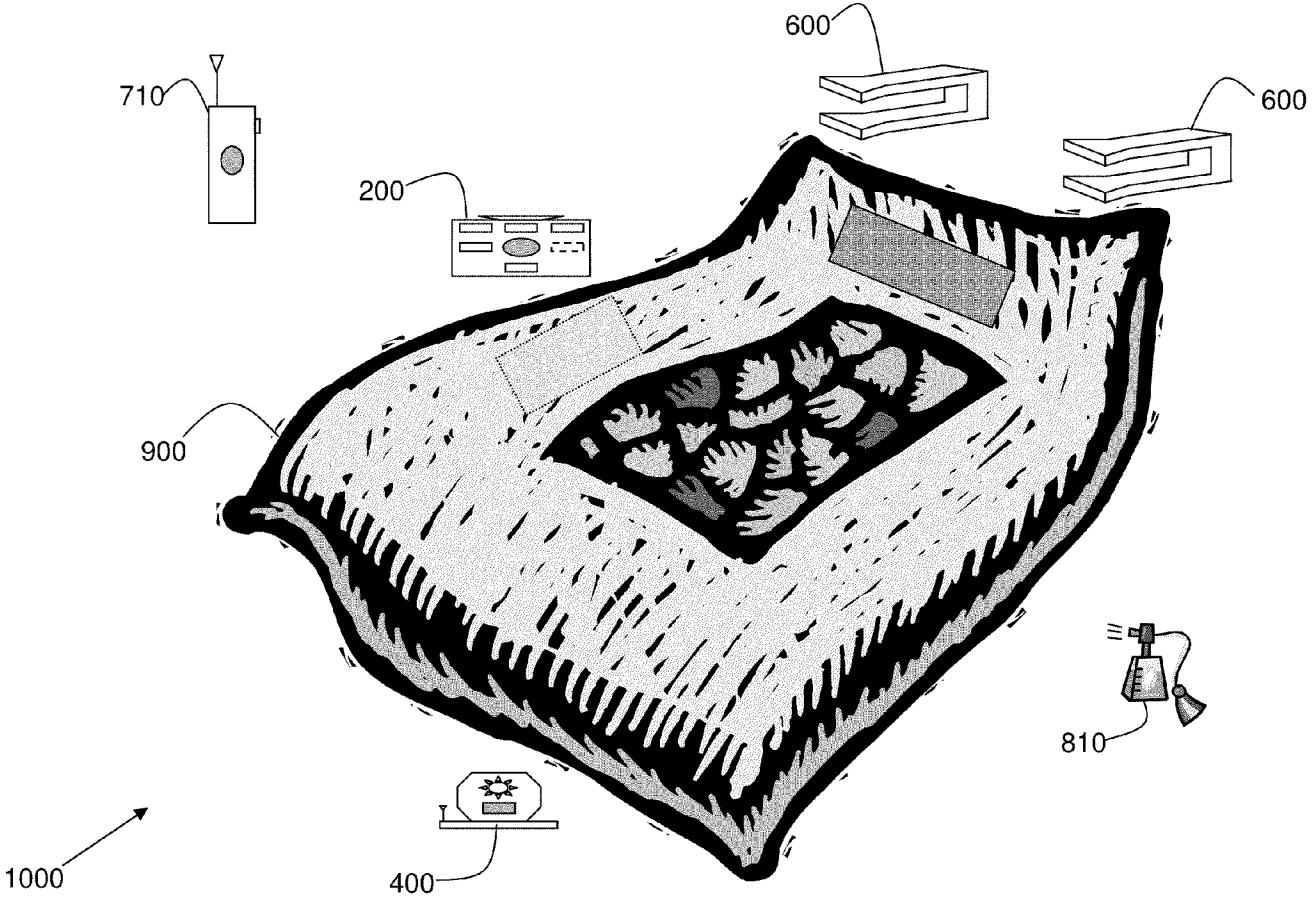
FIG. 10 illustrates an example embodiment of the kit of FIG. 8 further including the blanket or cover of FIG. 9.

FIG. 10 illustrates a further example embodiment of a kit 1000 for staving off monsters, specters, demons and the like as imagined by a child, where the kit 1000 includes a hand-held controller unit 200, an external device 400, two hollow air-through members 600, a walkie-talkie transceiver device 710, scented perfume 810, and the blanket or bed cover 900. Such a kit 1000 may be provided for sale in order to convert or retrofit an existing child's bed and coverings with the elements of the kit 1000 in order to stave off monsters, specters, demons and the like as imagined by the child.

Other kits having other combinations of the various elements described herein may be provided as well, in accordance with other embodiments of the present invention. For example, a kit may include only a hand-held controller unit 200, one hollow air-through member 600, and the external device 400. Another kit may include only two hollow air-through members and the fastenable insignia 110. Still another kit may include only the blanket 900, the hand-held control unit 200, and the scented perfume 810 (e.g., this embodiment may assume that the walkie-talkie capability is not desired, or that the walkie-talkie transceiver device 710 is not needed as part of the kit because the child and/or the parent already owns a walkie-talkie transceiver device which is operable with the hand-held controller unit 200).

A kit may also include a variation of color coded crystals, or colored materials, which may be comprised of special fabrics (e.g., silk) which helps, in the mind of the child, to stave off the unfriendlies. Additionally, pajamas, a security blanket, stuffed animals, or any other similar children's item may be configured with insignia or special monster repellant designs or colors, in accordance with further embodiments of the present invention.

Figure 11:
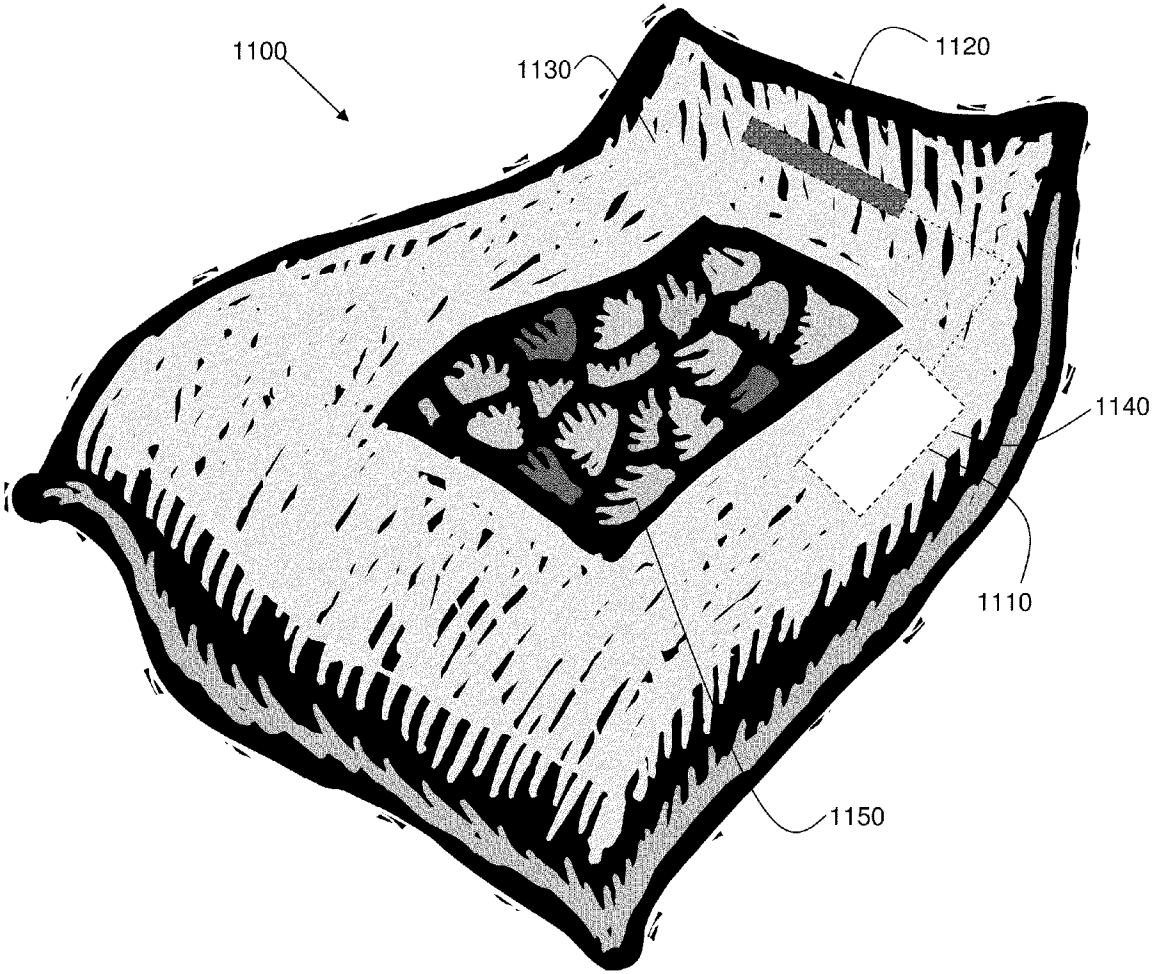
FIG. 11 illustrates an example embodiment of a cover having a controller unit and user interface integrated therewith.

In accordance with an alternative embodiment of the present invention, the hand-held controller unit 200 (or portions thereof) and/or the external device 400 (or portions thereof) may be integrated into the blanket 900. A child may squeeze a select user interface part of the blanket or cover 900, thereby activating the external device 400 or any other function provided by the controller unit 200. For example, FIG. 11 illustrates an example embodiment of a cover 1100 having a controller unit 1110 and user interface 1120 integrated therewith. The controller unit 1110 is very similar to the controller unit 200 of FIG. 2, except that the user interface 1120 has been separated out from the controller unit 1110 and sewn into an external surface 1130 of the cover 1100. The controller unit 1110 is integrated into an interior region 1140 of the cover 1100. The user interface 1120 is operatively connected to the controller unit 1110. The cover 1100 includes a plurality of insignia 1150 printed or sewn on the external surface 1130 for staving off monsters, specters, demons and the like as imagined by a child.

In summary, devices and implements for staving off monsters, specters, demons and the like as imagined by a child at bedtime are disclosed. A hand-held controller unit is provided having a user interface and which is capable of being used by the child under the bed covers of a bed. The hand-held controller unit may include any of a walkie-talkie capability, a flashlight capability, a nightlight capability, the capability to activate an external device, and other capabilities. At least one external device may be provided. The external device may be capable of being placed beneath the bed and is configured to be activated by the hand-held controller unit. At least one substantially hollow air-through member may be provided which is configured to facilitate airflow between underneath the bed covers of the bed and above the bed covers of the bed. A supplemental bed cover may be provided that is configured to be placed on the bed. The supplemental bed cover may include insignia to help stave off the monsters, specters, demons and the like as imagined by the child.

While the claimed subject matter of the present application has been described with reference to certain embodiments, it will be understood by those skilled in the art that various changes may be made and equivalents may be substituted without departing from the scope of the claimed subject matter. In addition, many modifications may be made to adapt a particular situation or material to the teachings of the claimed subject matter without departing from its scope. Therefore, it is intended that the claimed subject matter not be limited to the particular embodiments disclosed, but that the claimed subject matter will include all embodiments falling within the scope of the appended claims.

What is claimed is:

1. A hand-held controller unit for providing comfort to a frightened child, said hand-held controller unit comprising:

a housing constructed at least in part of a compressible material;

a user interface integrated with said housing and configured to respond to a user initiated action;

a user interface control circuit integrated within said housing and operatively connected to said user interface;

walkie-talkie circuit integrated within said housing and operatively connected to said user interface control circuit, wherein said walkie-talkie circuit is configured to facilitate two-way communication between the child and a parent;

at least one activating transmitter circuit integrated within said housing and operatively connected to said user interface control circuit and configured to wirelessly activate at least one external device located remotely from said hand-held controller unit, wherein activation of said at least one external device results in said at least one external device producing one or more of an audible sound or a pulsating visible light, and wherein the external device is automatically deactivated based on one or more conditions; wherein the one or more conditions includes an amount of light detected by a light sensor and at least one energy-emitting device integrated with said housing and operatively connected to said user interface control circuit.

2. The hand-held controller unit of claim 1 further comprising an audio transducer integrated with said housing and operatively connected to said walkie-talkie circuit.

3. The hand-held controller unit of claim 1 wherein said at least one energy-emitting device includes at least one of a flashing visible light-emitting device and an audible sound-emitting device.

4. The hand-held controller unit of claim 1 wherein said at least one energy-emitting device includes a flashlight.

5. The hand-held controller unit of claim 1 wherein said user interface includes at least one depressible member configured to communicate a signal to said user interface control circuit in response to said user initiated action.

6. The hand-held controller unit of claim 5 wherein said at least one depressible member provides visible illumination serving as a nightlight capability.

7. The hand-held controller unit of claim 1 wherein said user interface provides visible illumination serving as a nightlight capability.

8. The hand-held controller unit of claim 1 wherein said at least one activating transmitter circuit includes a wireless transmitter.

9. The hand-held controller unit of claim 1 wherein said at least one external device includes at least one of an audio producing device and a pulsating light producing device.

10. A kit for providing comfort to a frightened child at bedtime, said kit comprising:

the compressible hand-held controller unit of claim 1 configured to be used by the child under bed covers of a bed;

at least one substantially hollow air-through member configured to facilitate airflow between underneath the bed covers of the bed and above the bed covers of the bed, and not through the bed covers of the bed, the hollow air-through member having a C-shaped configuration for use around an edge of the bed covers of the bed; and at least one external device configured to be placed underneath the bed and configured to be wirelessly activated by said hand-held controller unit in response to a child-initiated action, wherein activation of said at least one external device results in said at least one external device producing one or more of an audible sound or a pulsating visible light.

11. The kit of claim 10 wherein said hand-held controller unit includes means for facilitating audio communication between the child and a parent.

12. The kit of claim 10 wherein said hand-held controller unit includes means for wirelessly activating said at least one external device.

13. The kit of claim 10 wherein said at least one external device includes at least one of means for producing an audible sound and means for producing a pulsating visible light.

14. The kit of claim 10 wherein said hand-held controller unit includes means for emitting energy.

15. The kit of claim 14 wherein said means for emitting energy is configured to emit at least one of a flashing visible light, an audible sound, and a steady visible light.

16. The kit of claim 10 further comprising means for fastening at least one insignia to at least one of a bed cover of the bed and a post of the bed.

17. The kit of claim 10 further comprising a spray bottle for dispensing a scented perfume capable of being applied to the bedding of the bed and the child.

18. The kit of claim 10 further comprising a supplemental bed cover configured to be placed on the bed.

19. The kit of claim 18 wherein said supplemental bed cover includes a pocket for storing said hand-held controller unit.

20. The kit of claim 18 wherein said supplemental bed cover includes at least one air-through port configured to allow air to readily pass through said supplemental bed cover.

21. The kit of claim 18 wherein said supplemental bed cover includes a first side attached to a second side and is configured to fit over an existing bed cover.

* * * * *